United States Patent [19]

Spelber

[11] Patent Number: 4,573,642

[45] Date of Patent: Mar. 4, 1986

[54] WATER POWERED WASTE DISPOSER WITH IMPROVED DYNAMIC SEAL

[75] Inventor: Leonard G. Spelber, San Diego, Calif.

[73] Assignee: Wastemate Corporation, San Diego, Calif.

[21] Appl. No.: 607,648

[22] Filed: May 7, 1984

[51] Int. Cl.[4] ..... B02C 18/40

[52] U.S. Cl. ..... 241/46 B; 241/46.06; 241/100.5; 241/257 G

[58] Field of Search ..... 241/46 A, 46 B, 46.02, 241/46.04, 46.06, 46 R, 100.5, 257 G

[56] References Cited

U.S. PATENT DOCUMENTS 4,082,229 4/1978 Boosman ..... 241/46 B

*Primary Examiner*—Mark Rosenbaum

*Attorney, Agent, or Firm*—Brown, Martin & Haller

[57] ABSTRACT

An improved dynamic seal for a water powered waste disposer to increase operating efficiency under low water pressure conditions. The rotatable drive ring within the disposer is sealed between the water powered piston chamber and the waste cutting chamber. This seal comprises a thin band of sheet material secured to the drive ring and provides the desired sealing effect due, in part, to the water pressure in the piston chamber.

10 Claims, 9 Drawing Figures

FIG. 4
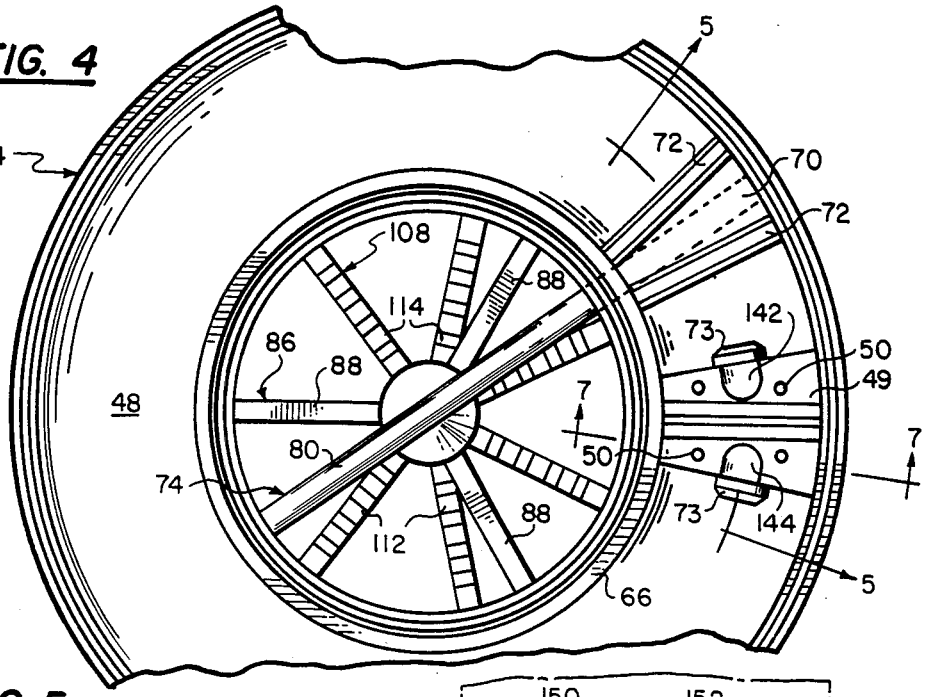
FIG. 5
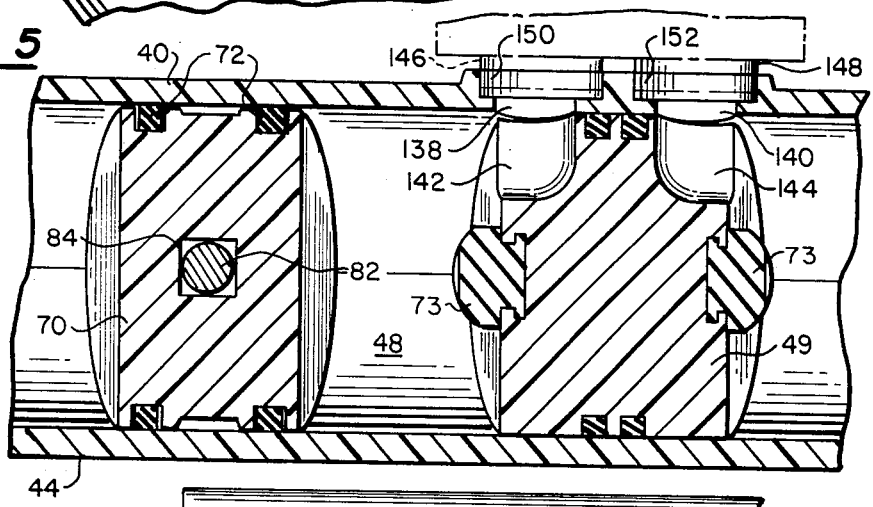
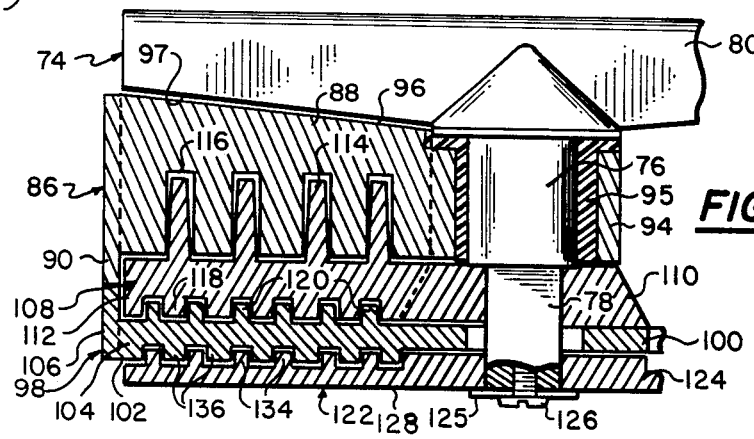
FIG. 6

WATER POWERED WASTE DISPOSER WITH IMPROVED DYNAMIC SEAL

FIELD OF THE INVENTION

This invention relates generally to waste disposers and more particularly to an improved dynamic seal for a water powered waste disposer.

BACKGROUND OF THE INVENTION

Waste disposer units, such as are typically used in the kitchen, in commercial establishments or on marine vessels, are usually driven by an electric motor, which rotates one- or two-stage cutters at high speed, often with considerable noise. In addition to requiring electrical wiring, there is a potential hazard of having electrical connections and water in the same structure, requiring very positive means to maintain absolute separation between the water and the electricity. Further, if the cutters are jammed by an obstruction, such as a bone, a piece of flatware or other hard object, the motor normally stalls and may become damaged. If an overload switch is installed it must be reset, and it is often in an inaccessible location. With the type of cutters normally used for electrical waste disposers, it is possible for fairly large particles to pass through the disposer and accummulate in a waste pipe bend, possibly causing ultimate blockage of the drain, particularly if insufficient flush water is used.

Water driven units have been developed. A typical early example is disclosed in U.S. Pat. No. 3,700,178, which has a reversing valve actuated by a drive piston at each end of its stroke. This particular structure could result in a jammed condition when a hard object entered the disposer in a partial stroke position. A substantially improved version is shown in U.S. Pat. No. 4,082,229, which discloses a practical water powered waste disposer capable of efficient operation at normal dynamic water pressure of approximately 30 pounds. However, in locations where the water pressue is below 30 pounds, the waste disposer shown in that patent tends to operate with less efficiency for its intended purpose. Certain built-in leakage of water within the unit is not only permissible, but is necessary for the unit to operate properly. However, this leakage resulted in requiring a certain minimum (30 pounds) water pressure which may not be available in some locations.

SUMMARY OF THE INVENTION

Broadly speaking, this invention relates to an improved dynamic or skirt seal for a water powered waste disposer similar to that shown in U.S. Pat. No. 4,082,229, to permit a disposer made in accordance with that patent to operate efficiently for its intended purpose at a substantially reduced water pressure.

The skirt seal of the present invention replaces two seal rings used in the previous disposer unit at substantially less cost and with substantially improved efficiency.

The waste disposer which is the subject of this invention (and the device shown in U.S. Pat. No. 4,082,229) is operated entirely by water, the domestic supply of water normally having ample pressure for effective operation. A drive piston moving in a toroidal chamber and driven by water pressure is coupled to a stack of alternately moving and stationary cutters. The moving cutters have a reciprocating rotary motion and are provided with staggered interfitting teeth, which reduce waste material progressively to small particles. The lowermost cutter has restricted openings which will not pass any large particles, nor will it permit the handles of flatware or the like to pass through should they accidentally fall into the unit.

A servo controlled valve, responsive to differential pressure on opposite sides of the piston, reverses the flow and the piston direction automatically at the end of each stroke. The automatic reversal also occurs if an obstruction jams the cutter, the cutters then oscillating with a reduced stroke until the obstruction is cut off or removed. No damage is caused to the unit by such action since the operating pressure is merely that of the available water supply.

The driving water is exhausted through the control valve into a manifold from which it is sprayed into the cutting chamber to flush waste material through the cutters and out of the disposer. The unit is quiet in operation and it has been found capable of cutting up small bones, corn cobs and other fibrous material which could jam an electrically driven unit.

The seal structure of this invention enables the disposer described herein to function efficiently, and for its intended purpose, with the dynamic water pressure as low as 15 pounds. This seal accomplishes the purpose described at a cost which is approximately 90% less than the seals used in the disposer described in U.S. Pat. No. 4,082,229.

BRIEF DESCRIPTION OF THE DRAWING

The objects, advantages and features of this invention will be more readily perceived from the following detailed description when read in conjunction with the accompanying drawing, in which:

FIG. 4 is a top plan view of the unit with the upper housing removed;

FIG. 5 is an enlarged sectional view taken on line 5—5 of FIG. 4;

FIG. 6 is an enlarged sectional view, similar to a portion of FIG. 2, showing the cutter stack of the disposer;

DESCRIPTION OF THE PREFERRED EMBODIMENTS

Figure 1:
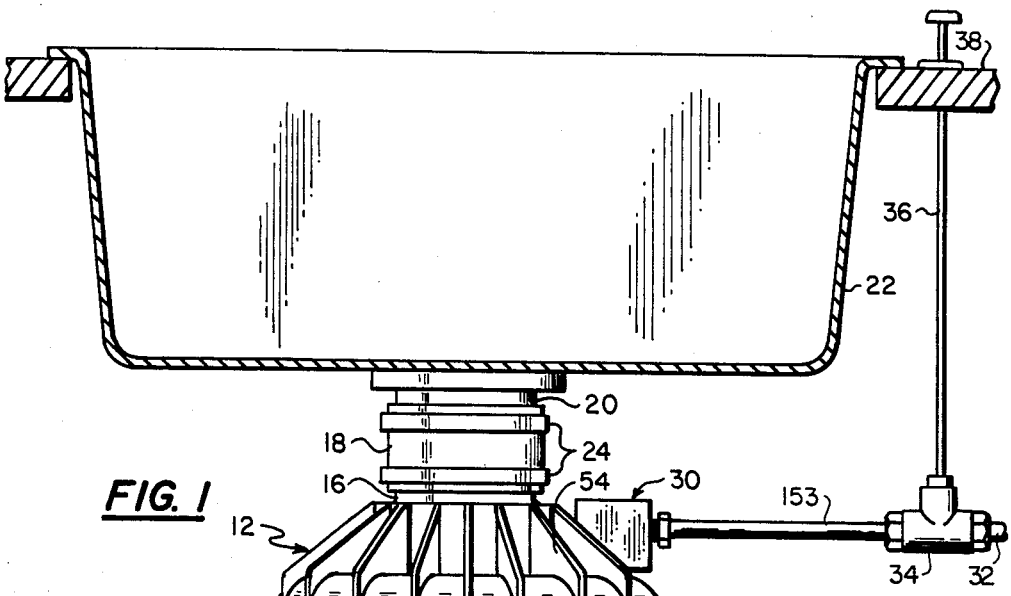
FIG. 1 is a side elevation view of a typical installation of the present waste disposer.

With reference now to the drawing, and more particularly to FIGS. 1-7, the basic structure of the water powered disposer will be described. Disposer unit 10 has an upper housing 12 and a lower housing 14, in which all of the mechanism of the unit is contained. Upper housing 12 has a neck 16 which is connected by a coupling 18 to the drain collar 20 of a sink 22. Clamp bands 24, or other suitable means, secure the coupling 18 with a watertight connection. Lower housing 14 has a drain outlet 26 which is connected to a drain pipe 28. The unit is light in weight and can be suspended from the conventional drain collar 20, although additional support may be used if desired.

A control valve unit 30 is mounted on upper housing 12 and is coupled to a water supply line 32 through a valve 34. An actuating rod 36 extends from valve 34 through the counter surface 38 alongside the sink, or to any other convenient position, for turning the disposer unit on and off.

Figure 2:
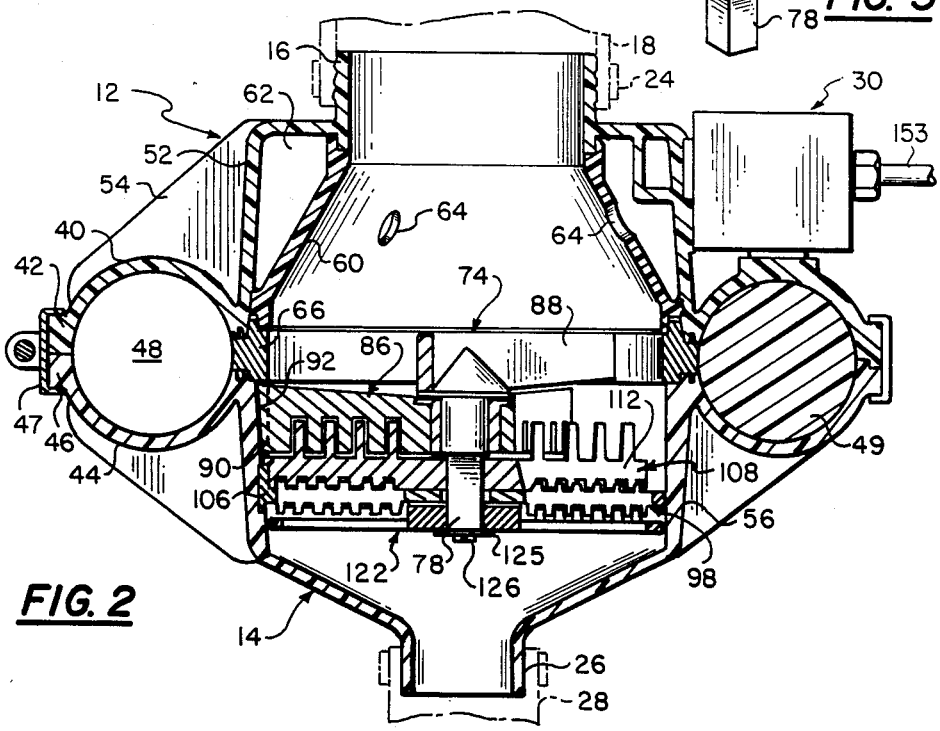
FIG. 2 is an enlarged diametrical sectional view of FIG. 1.

With reference to FIGS. 1 and 2, upper housing 12 has a toroidal portion 40 with a peripheral flange 42, and lower housing 14 has a toroidal portion 44 with a peripheral flange 46. The housings are secured together by a channelled clamp band 47 fitted over flanges 42 and 46, the toroidal portions combined forming a toroidal chamber 48. A stop plug 49 (see FIG. 4) provides a fixed wall at one point in the toroidal chamber. The plug is held in place by lock pins 50, which are inset into housings 12 and 14 as shown in FIG. 7.

The upper housing 12 has a substantially cylindrical mean body 52, to which the toroidal portion 40 is braced by radial reinforcing fins 54. Lower housing 14 has a similar cylindrical body 56 with reinforcing fins 58 extending to toroidal portion 44. Inside the upper body 52 is a downwardly diverging shower cone 60, extending from neck 16 to the inner periphery of the toroidal portion 40. A manifold chamber 62 is enclosed between body 52 and cone 60, the cone having spray ports 64 opening inwardly from the manifold. While the body portion of the disposer is described as generally cylindrical, the shape of the inner chamber and the manifold are not critical to the invention.

The inner periphery of toroidal chamber 48 has an annular gap in which is the outer portion of rotatable drive ring 66. The function of this drive ring will be described in further detail below. Although there is water in both the waste cutting chamber and the piston chamber, these chambers must be effectively sealed one from the other because there is substantial pressure differential between them which is the basis for the operation of the disposer.

Figure 7:
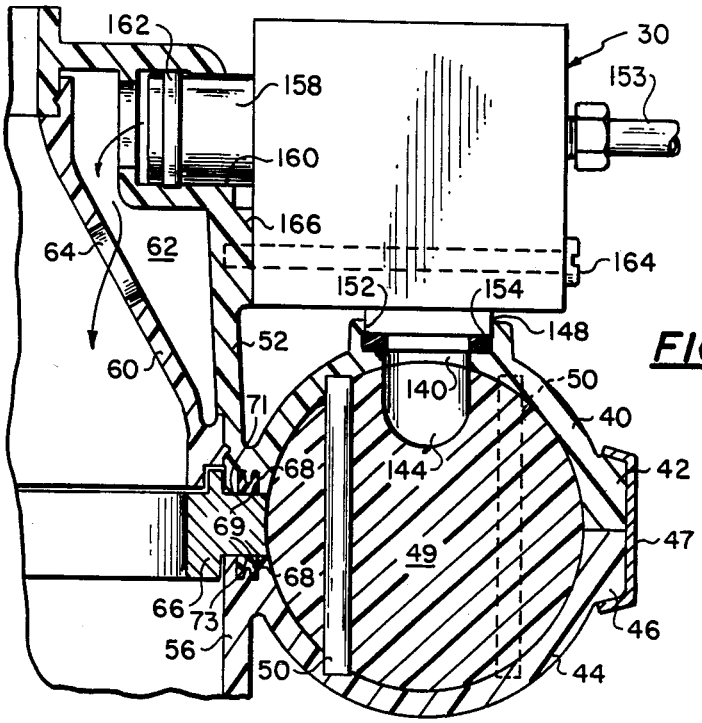
FIG. 7 PRIOR ART
FIG. 7 is an enlarged sectional view taken on line 7—7 of FIG. 4 showing the prior art seal rings.

In the prior art structure shown in FIG. 7, the seal is provided by two seal rings 68. These seal rings are of channelled cross section seated in annular grooves 69. The grooves and configuration of the seals are so related that water pressure in piston chamber 48 enters beneath the outer lip of each seal ring 68 and tends to push the seal ring out of grooves 69 to provide a more effective seal between the upper and lower toroidal (40, 44) and housing portions (52, 56) and drive ring 66. Piston 70 (FIG. 4), having piston rings 72, slides in toroidal chamber 48 and is coupled through drive ring 66 to the cutter assembly as will be described later. Stop plug 49 may include resilient bumpers 73 on opposite sides to cushion piston 70 at the end of its travel around chamber 48.

In order for the seal rings 68 to function as desired, that is, to effectively prevent substantial water passage between the piston chamber and the waste cutting chamber, while allowing sliding action between the seal rings and drive ring 66, it is necessary that drive ring outer portion upper and lower bearing surfaces 71 and 75 be precisely flat for proper seal against water pressure. Any grooves or waviness whatsoever in these surfaces could reduce the efficiency of the disposer and require an increased dynamic water pressure for it to function effectively. The bearing surface of each seal ring 68 has a molded annular ring, preferably made of polytetrafluoroethylene, which provides the necessary wear factor as well as lubricity for the constant sliding action between the seal rings and the drive ring.

Even though this structure has enabled the unit to function well as a disposer with at least 30 pounds of water pressure, it has been found that seals 68 permit too much water leakage between the piston chamber and the waste cutting chamber to permit operation at substantially less than 30 pounds of water pressure. This is not to say that there should be no leakage between these chambers but it should be at a minimum to permit efficient functioning of the disposer.

Figure 8:
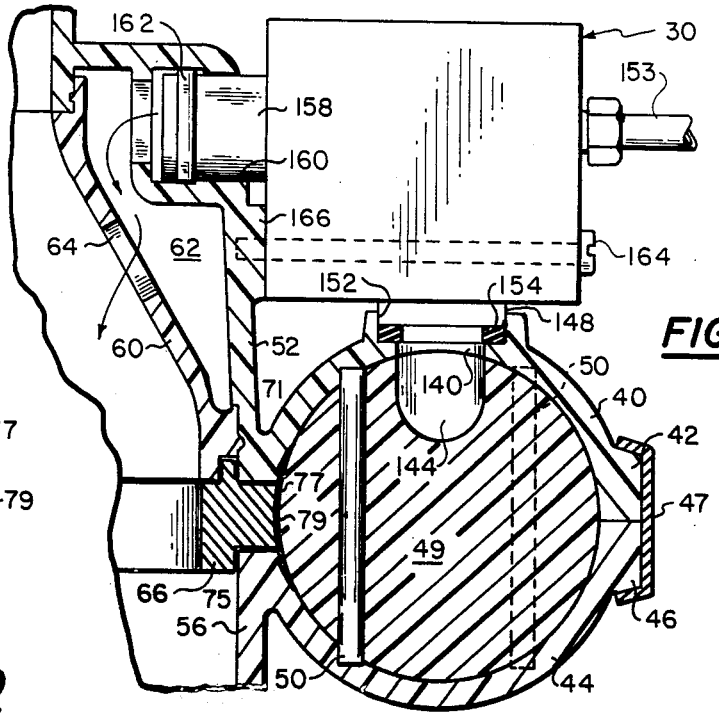
FIG. 8 is an enlarged sectional view similar to FIG. 7 showing the skirt seal of the present invention.
Figure 9:
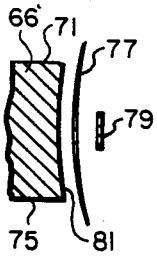
FIG. 9 is an enlarged, explode view of a portion of FIG. 8 showing the skirt seal of this invention.

The improved skirt seal of the present invention is shown in FIG. 8. The relatively expensive seal rings 68, currently in the range of six dollars each, are no longer needed and the seal is accomplished by a thin band 77 of sheet material mounted to the outer circumference of drive ring 66. A strap 79 is one convenient means for securing band 77 to the drive ring. This strap may be made of any appropriate material and a metal is preferred because of the strength and wear resistance required. It must also be non-corrosive. Alternatively the band may be secured by staples, rivets, adhesives or any other appropriate means. It has been found that the water pressure in toroidal chamber 48 is adequate to retain band 77 to drive ring 66 and specific band securing means may be omitted entirely. The basic requirement for the securing means, if one is used, is that it have minimal thickness and not project radially appreciably beyond the surface of band 77. The entire structure must be thin enough to allow it to pass by stop plug 49 as the drive ring rotates under the impetus of piston 70. Another requirement of band 77 is that it have high abrasion resistance. Preferably it will also be of self lubricating material such as a polytetrafluoroethylene. Bands made of Mylar or Teflon, among other materials, could be used.

As presently contemplated, the skirt seal 77 is approximately $1\frac{1}{4}$ inch (31.75 mm) in width and extends approximately $\frac{1}{4}$ inch (6.35 mm) beyond the upper and lower surfaces of drive ring 66, thereby overlapping approximately the same distance on the inside of toroidal portions 40 and 44. It is also preferred that the strip be made of a conformable plastic material and will have a thickness of about 0.010 inch (0.254 mm). However, the thickness of the skirt seal can range from 0.005–0.032 inch (0.127–0.82 mm). If the seal band 77 is too thick, it will prevent easy assembly and could also interfere with motion of the drive ring. On the other hand, if the seal band is too thin, it could possibly buckle or curl, or maybe even bunch up due to the friction as the drive ring rotates past stop plug 49. Of particular importance is that band 77 and appropriate means for securing it to the drive ring are expected to cost just slightly more than one dollar, approximately 90% less than the seal rings which the skirt seal of this invention replaces.

For proper fit and operation purposes, it is preferable that the seal band 77 have an outward flare from drive ring 66. If the top portion of band 75 did not flare outward somewhat, it could be very difficult to assemble upper housing 12 to lower housing 14. The outward curl can be provided in different ways. The band 77 may be preformed with the necessary flare in the final form shown in FIG. 8 or, because of the arcuate shape of the outer surface 81 of drive ring 66, the process of securing band 77 to the drive ring so that there is surface contact between them will tend to create the desired outward flare. Additional shaping after mounting may be accomplished if desired.

There are several advantages to the seal of the present invention. One of them is that expensive seal rings 68 are no longer necessary. Additionally, it is not necessary to use expensive precision forming to assure perfect flatness of the top and bottom annular surfaces 71, 75 of the drive ring because there is no bearing function any longer at these surfaces. Seal 77 is sufficiently flexible to accommodate normal irregularities in the surfaces of toroidal portions 40 and 44 immediately adjacent the drive ring. Thus expensive precision, expensive components and close tolerances are not necessary with the present invention as it relates to the sealing function between the toroidal chamber 48 and the waste cutting chamber. Yet the seal of this invention increases efficiency by 50% over the earlier seal in that it permits the waste disposer to operate at 50% less minimum pressure that was required with the prior art seal.

Figure 3:
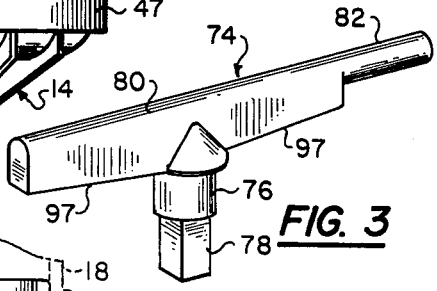
FIG. 3 is a perspective view of the first stage drive cutter employed in the disposer of FIG. 1.

The stacked cutter assembly, as illustrated, includes three movable and two fixed cutters in alternate arrangement, but more or less cutters could be used if desired. The first, or drive cutter 74, is shown in FIGS. 3 and 4 and has a cylindrical post 76 with an extended lower boss 78 of square or otherwise non-circular cross section. On the upper end of post 76 is a cutter bar 80 which extends diametrically across drive ring 66. One end of the cutter bar 80 has a drive pin 82 which projects through drive ring 66 into socket 84 of piston 70 (see FIG. 5), making the drive connection between the piston and the cutters. Skirt seal band 77 may be formed with holes to accommodate drive pin 82. This provides the only anchoring necessary when the band is held in place on the drive ring by water pressure.

Immediately below drive cutter 74 is a fixed cutter 86 having radial shear blades 88, three such blades being indicated. Cutter 86 has lugs 90 on the outer ends of the blades which seat in sockets 92 (see FIG. 2) in lower housing body 56 to hold the cutter against rotation. As shown in FIG. 6, cutter 86 has a central hub 94 with a bushing 95, which acts as a bearing for drive cutter post 76. The upper surfaces 96 of shear blades 88 and the lower faces 97 of cutter bar 80 are flat and pass closely for the initial shearing action on the waste material.

Spaced below cutter 86 is another fixed cutter 98 having a central hub 100 and a peripheral ring 102, with a plurality of shear blades 104 therebetween. Ring 102 has lugs 106 (FIG. 6) which fit into sockets 92 and space the two fixed cutters 86 and 98. Shear blades 104 are each inclined relative to a radius from hub 100, to provide a slicing rather than perpendicular shearing action.

Between cutters 86 and 98 is a rotary cutter 108 having a hub 110 keyed to square boss 78 to rotate with drive cutter 74. Extending from hub 110 are radial cutting blades 112, seven such blades being indicated in FIG. 4. It should be noted that only cutters 74, 86 and 108 are shown for clarity in this figure. On the upper face of each cutting blade 112 are radially spaced upwardly projecting teeth 114 which pass closely through corresponding spaced slots 116 in shear blades 88 of fixed cutter 86. On the lower face of each cutting blade 112 are downwardly projecting teeth 118 which pass closely between upwardly projecting teeth 120 on the shear blades 104 of fixed cutter 98.

Below fixed cutter 98 is a rotary cutter 122 having a central hub 124 which is keyed on boss 78. Cutter 122 is held in place by a washer 125 (FIG. 6) and a screw 126 threaded axially upwardly into boss 78. Cutter 122 has a plurality of bars 128 inclined to the radius with appropriately shaped slots (not shown) between bars 128 to define the openings through which the waste material passes. The openings between bars 128 of this cutter are such a small proportion of the total cutter surface area that it may be described as having a webbed structure. On top of each bar 128 are radially spaced teeth 134 which project over the slots to minimize the openings and prevent passage of large particles, flatware or the like. Teeth 134 are circumferentially inclined and pass closely between teeth 136 on the lower face of fixed cutter 98 with a shredding action.

It should be noted that FIG. 6 shows the teeth of the various cutters intermeshed for illustrative purposes only. The cutters all have different numbers of blades so that the shearing action between cutters is staggered, that is, the cutters would never all meet simultaneously as shown. In this way the load is distributed more evenly throughout the cutting action.

The toroidal portion 40 has a pair of inlets 138 and 140 (see FIG. 5) at the top portion of stop plug 49. The stop plug has channels 142 and 144 which connect the respective inlets to the toroidal chamber 48 on opposite sides of the stop plug. Valve unit 30 has a pair of supply outlets 146 and 148 which seat into sockets 150 and 152 of inlets 138 and 140, respectively, and are sealed by seal rings 154 (FIG. 7). Valve unit 30 also has a water supply inlet 153 and a pair of exhaust outlets 158, one being shown in FIG. 7, which plug into sockets 160 in housing body 52, the sockets opening into manifold chamber 62. Exhaust outlets 158 are sealed in sockets 160 by O-rings 162, or the like. The valve unit is secured to the thickened portion 166 of body 52 by means of screws 164 as shown in FIG. 7.

The mechanism of valve 30 is shown in U.S. Pat. No. 4,082,229 and is not pertinent to the present invention. The structure and assembly techniques for such a valve are well known. Basically it functions to cause piston 70 to reciprocate around toroidal chamber 48 from one side of stop plug 49 to the other side. The valve also functions in a similar manner should some material or foreign object stop the normal operation midstroke so that it will then oscillate until the obstruction is removed. At the end of each cycle of piston travel, reversal is automatically initiated by the pressure differential sensed within the valve structure. Reversal will also occur if the cutters are jammed by an obstruction or object too hard to cut, resulting in a sudden increase in the pressure differential on opposite sides of the piston. The action is automatic at any supply pressure, since the control valve is pressure balanced to the supply. It has been found that the cutters will continue to oscillate through any length of stroke until the obstruction is eventually cut off or removed.

The exhausted water, after driving the piston, is ejected into manifold chamber 62 and sprayed through ports 64 into the cutting chamber with a flushing action. It is not necessary to run flush water into the unit as with a typical electrical type disposer.

The unit is quiet in operation, the cutters oscillating at about 15 to 25 cycles per minute, depending on the water pressure. The oscillating progressive shearing action is very powerful and a large quantity of waste can be disposed of rapidly.

In view of the above description, it is likely that modifications and improvements will occur to those skilled in the art which are within the scope of the accompanying claims.

What is claimed is:

1. A water powered waste disposer comprising:

a housing having an upper waste material receiving neck and a lower drain outlet and defining a waste cutting chamber, said housing being formed of an upper portion and a lower portion;

a plurality of stacked cutters mounted in said waste cutting chamber, certain of said cutters being rotatable, said cutters being mounted in said lower portion:

an annular toroidal chamber mounted to said housing and having an inner periphery;

a stop plug in said chamber and blocking said chamber at one position;

a piston mounted within said toroidal chamber for sliding movement around said chamber;

means to connect said piston to said rotatable cutters;

a pair of water inlets in said toroidal chamber on opposite sides of said stop plug;

valve means coupled to said inlets and having means for connection to a source of water, said valve means controlling the operation of said piston so that it reciprocates around said toroidal chamber to opposite sides of said stop plug;

a drive ring rotatably mounted between said upper and lower housing portions in the inner periphery of said toroidal chamber and being connected between said piston and said rotatable cutters, said drive ring having an outer surface opening into said toroidal chamber, said outer surface defining a portion of the inner periphery thereof;

a band of thin plastic material mounted to and covering said outer surface of said drive ring, said band extending beyond said outer surface over the immediately adjacent upper and lower portions of said inner periphery of said toroidal chamber and providing a normally moving seal between said toroidal chamber and said cutting chamber;

an annular manifold chamber mounted to said upper housing portion, said manifold chamber having circumferentially spaced spray ports directed toward said cutters; and said valve means having exhaust outlets opening into said manifold chamber with means for exhausting water from said toroidal chamber into said manifold chamber.

2. The waste disposer recited in claim 1 wherein said band overlaps from said outer surface to said adjacent upper and lower portions of said toroidal chamber inner periphery by about ¼ inch.

3. The waste disposer recited in claim 1 wherein said band is made of a self lubricating material.

4. The waste disposer recited in claim 3 wherein said band is made of a polytetrafluoroethylene.

5. The waste disposer recited in claim 3 wherein said band is made of Mylar.

6. The waste disposer recited in claim 1 wherein said band has a thickness ranging between 0.005 and 0.032 inch.

7. The waste disposer recited in claim 1 wherein said band is secured to said outer surface by means of a thin circumferential strap.

8. The waste disposer recited in claim 7 wherein said strap is made of metal.

9. The waste disposer recited in claim 1 wherein said band is secured to said outer surface by means of an adhesive.

10. The waste disposer recited in claim 1 wherein said band is secured to said outer surface by means of rivets.

* * * * *